US006672206B2

(12) United States Patent
Villarreal

(10) Patent No.: US 6,672,206 B2
(45) Date of Patent: Jan. 6, 2004

(54) FORM ROLLER FOR PRINTING PRESS

(75) Inventor: Jose A. Villarreal, Kemp, TX (US)

(73) Assignee: Graphic Specialists, Inc., Kemp, TX (US)

( * ) Notice: Subject to any disclaimer, the term of this patent is extended or adjusted under 35 U.S.C. 154(b) by 0 days.

(21) Appl. No.: 10/335,625

(22) Filed: Jan. 2, 2003

(65) Prior Publication Data

US 2003/0150344 A1 Aug. 14, 2003

Related U.S. Application Data

(60) Provisional application No. 60/345,808, filed on Jan. 4, 2002.

(51) Int. Cl.[7] ..... B41F 31/00

(52) U.S. Cl. ..... 101/350.3; 101/DIG. 38

(58) Field of Search ..... 101/350.03, 350.06, 101/375, DIG. 38, 216, 142

(56) References Cited

U.S. PATENT DOCUMENTS 4,170,176 A * 10/1979 Domeniconi ..... 101/330
4,397,236 A * 8/1983 Greiner et al. ..... 101/350.3
4,493,257 A * 1/1985 Kubert et al. ..... 101/350.3
4,546,701 A * 10/1985 Junghans ..... 101/350.3
4,739,703 A * 4/1988 Eguchi ..... 101/350.3
4,809,606 A * 3/1989 Day et al. ..... 101/350.3
5,134,939 A * 8/1992 Borne ..... 101/DIG. 38
5,351,614 A * 10/1994 Depa ..... 101/DIG. 38
5,632,203 A * 5/1997 Voeltner et al. ..... 101/DIG. 38
6,220,159 B1 * 4/2001 Wieland ..... 101/350.3
2003/0079632 A1 * 5/2003 Schaffrath ..... 101/350.3

* cited by examiner

*Primary Examiner*—Eugene H. Eickholt
(74) *Attorney, Agent, or Firm*—Michael A. O'Neil

(57) ABSTRACT

A form roller for use in an offset lithographic printing press comprises a stationary shaft and an eccentric roller supported on the shaft for rotation around the shaft and for oscillation along the length of the shaft. One or more cams are mounted on the shaft for controlling the operation of the rollers therealong. The exterior surface of the roller comprises an impregnated elastomeric material.

7 Claims, 2 Drawing Sheets

FORM ROLLER FOR PRINTING PRESS

This application claims priority of prior provisional Application Serial No. 60/345,808 filed Jan. 4, 2002, currently pending.

TECHNICAL FIELD

This invention relates in general to offset lithographic printing press technology. In particular, the invention relates to an offset lithographic printing press having an improved form roller which eliminates hickeys, ghosting, and other distortions.

BACKGROUND OF THE INVENTION

A typical offset lithographic printing press has a plate cylinder upon which the negative of the text and illustrations to be printed is etched by a photographic and/or electronic process. Dampening rollers apply water to the plate cylinder, and the water adheres to the plate cylinder except where the text and illustrations are located.

Next, a series of form rollers, also known in the art as inking rollers, apply a layer of ink to the plate cylinder. The ink adheres to the plate cylinder only where the text and illustrations are located.

The plate cylinder then presses the inked text and illustrations onto a rubber blanket cylinder. An impression cylinder then presses a sheet of paper or other material to be printed against the blanket cylinder as the paper or other material passes between the blanket cylinder and the impression cylinder. The inked text and illustrations on the blanket cylinder are transferred onto the paper or other material to effect printing thereof.

One or more of the form rollers may be driven by a vibrating roller. The vibrating rollers may also oscillate laterally to pass the ink more evenly to the form rollers. One or more of the form rollers may be cooled to chill the ink thereby preventing moisture loss.

Impurities and/or clumps of ink on the vibrating rollers may cause the ink to be spread unevenly onto the form rollers. This can cause small dots, commonly referred to as hickeys, to appear on the paper or other material being printed. A related problem involves ghosting of the printed image. Thus, a need exists for a form roller which eliminates hickeys, ghosting, and other distortions that frequently occur in offset lithography.

SUMMARY OF THE INVENTION

The present invention comprises a new and improved inking system useful in offset lithography. More particularly, the invention comprises an eccentric, oscillating form or inking roller. The eccentric action increases and decreases pressure between the form roller and the plate cylinder, which in conjunction with oscillating motion (lateral side to side movement of the form roller in a non-uniform manner) eliminates foreign particles and ink clumps thereby substantially reducing hickeys, ghosting, and other distortions of the printed image.

More particularly, the invention includes an eccentric form roller. The form roller is driven through friction circumferentially and laterally by the corresponding vibrating roller. The form roller is marked on the low side of the eccentric. As the form roller is driven circumferentially by the vibrating roller, the contact between the form roller and the plate cylinder changes from minimal pressure to substantial pressure. Simultaneously, one or more cams move or control the movement of the form roller back and forth laterally in a non-uniform manner. The combination of these actions substantially eliminates foreign particles and clumps of ink which eliminates hickeys, ghosting, and other distortions, thereby substantially increasing the quality of the printing.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1:
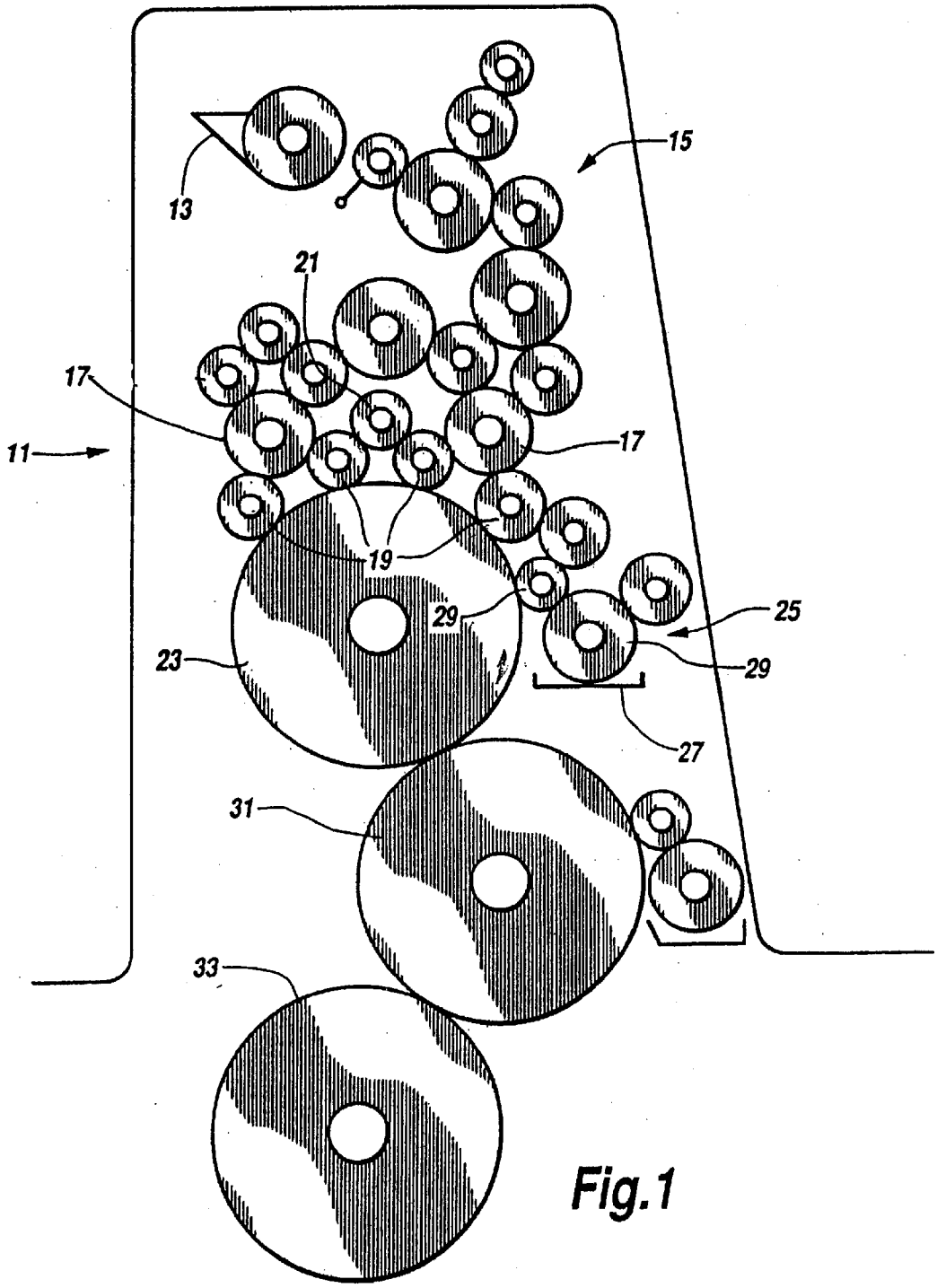
FIG. 1 is a diagrammatic illustration of an offset lithographic printing press.

FIG. 1 illustrates the working of a typical offset lithographic printing press 11. Ink is stored in an ink tray 13 near the top of the press 11.

The ink flows downward through a series of rollers 15 to a pair of vibrating rollers 17. The rollers 15 and the vibrating rollers 17 are cylindrical and have parallel axes. The vibrating rollers 17 oscillate back and forth along their longitudinal axes to spread the ink evenly. In some cases, the vibrating rollers 17 may be cooled to chill the ink thereby reducing moisture loss.

The vibrating rollers 17 deliver the ink to a plurality of form rollers 19. The form rollers 19 may also contact a bridge roller 21. The form rollers 19 are mounted in the press 11 in contact with a plate cylinder 23. The form rollers 19 are thus mounted between the vibrating rollers 17, the bridge roller 21, and the plate cylinder 23. The form rollers 19 transfer the ink to the plate cylinder 23.

A dampening system 25 is mounted in the press 11 to apply water to the plate cylinder 23. The dampening system 25 includes a water tray 27 and a series of rollers 29 between the tray 27 and the plate cylinder 23.

The plate cylinder 23 rolls against a blanket cylinder 31, and the blanket cylinder 31 rolls against an impression cylinder 33. The impression cylinder 33 pushes the paper or other material to be printed against the blanket cylinder 31 to cause ink to be transferred from the blanket cylinder 31 to the paper or other material as it passes between the blanket cylinder 31 and the impression cylinder 33.

Figure 2:
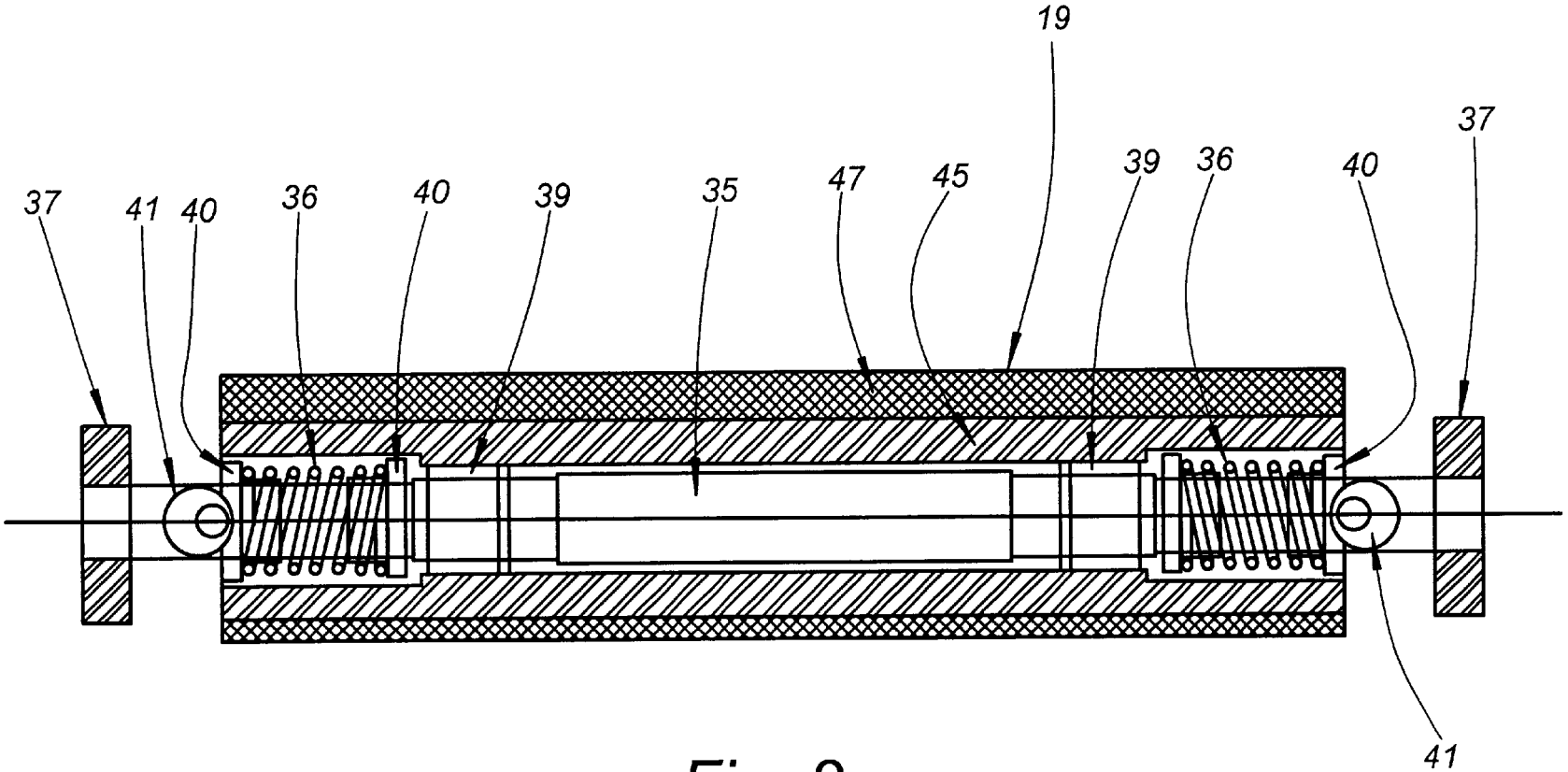
FIG. 2 is a longitudinal sectional view of the form roller of the present invention.

FIG. 2 illustrates the one embodiment of the present invention which comprises the form rollers 19 that are in contact with the oscillating vibrating rollers 17. Each form roller 19 includes a non-rotating shaft 35 with a bearing spacer 37 on each end. The bearing spacers 37 are attached to the press 11 in lieu of the rotating shaft of the prior art form roller.

A pair of bearings 39 are mounted on the shaft 35. The bearings 39 allow the form roller to rotate around and slide back and forth along the shaft 35. The form roller also contains a pair of springs 36. The springs 36 are secured on the shaft by two end caps 40. The springs 36 help create an erratic oscillation motion as contact pressure increases and decreases against the vibrating rollers 17. The form roller 19 also contains two cams 41 on each end thereof. The cams 41 control the oscillation of the form roller 19. The cams 41 can be rotated at the same or different speeds making the oscillation of the form roller 19 entirely random.

Each form roller 19 has a cylindrical core 45 surrounded with a cover 47. The core 45 is preferably made of metal, such as steel, and the cover 47 is made of rubber material, such as neoprene. The outer surface of the cover 47 is preferably a fabric or fiber impregnated elastomeric material. Other materials may be used depending upon the requirements of particular applications of the invention.

The shaft 35 defines an axis. The cylindrical core 45 is coaxial with the shaft 35. The cover 47 is substantially circular and is defined by an axis extending parallel to the and offset from the axis defined by the shaft 35.

As is clearly illustrated in FIG. 2, the cover varies in thickness around its circumference, thereby providing eccentricity. The eccentricity of the form rollers in conjunction with the longitudinal oscillation thereof eliminates foreign particles and ink clumps which in turn eliminates or substantially reduces hickeys, ghosting, and other distortions thereby substantially improving printing quality.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A form roller for offset lithographic printing presses comprising:

a stationary shaft defining an axis;

a roller mounted on the shaft for rotation around the shaft and for oscillation back and forth along the length of the shaft;

the roller having an exterior surface defined by an axis extending parallel to an offset from the axis defined by the shaft whereby the rotation of the roller around the shaft is eccentric;

the exterior surface of the roller comprising an impregnated elastomeric material.

2. The form roller according to claim 1 is further characterized by a cylinder mounted on the shaft for rotation about the axis thereof and an eccentric cover mounted on the cylinder and formed from an elastomeric material.

3. The form roller according to claim 1 further including at least one cam mounted on the shaft for controlling the oscillation of the cylinder lengthwise along the shaft.

4. The form roller according to claim 3 further including means for rotating the cam relative to the shaft and thereby randomly varying the oscillation of the roller along the shaft.

5. The form roller according to claim 1 wherein the exterior surface of the form roller comprises a fabric impregnated elastomeric material.

6. The form roller according to claim 1 wherein the exterior surface of the roller comprises a fiber impregnated elastomeric material.

7. The form roller according to claim 1 wherein the roller comprises a cylinder supported on the shaft for rotation about the axis thereof and an eccentric cover mounted on the roller and further including at least one cam mounted on the shaft for controlling the oscillation of the cylinder along the shaft.

* * * * *